United States Patent [19]

Petitpierre et al.

[11] Patent Number: 4,716,424

[45] Date of Patent: Dec. 29, 1987

[54] PRESSURE-SENSITIVE OR HEAT-SENSITIVE RECORDING MATERIAL

[75] Inventors: Jean C. Petitpierre, Riehen; Hermann Nachbur, Reinach; Albert Würmli, Riehen, all of Switzerland

[73] Assignee: Ciba-Geigy Corporation, Ardsley, N.Y.

[21] Appl. No.: 494,467

[22] Filed: May 13, 1983

[30] Foreign Application Priority Data

May 17, 1982 [CH] Switzerland ..... 3052/82

[51] Int. Cl.[4] ..... B41M 5/16; B41M 5/18; B41M 5/22

[52] U.S. Cl. ..... 503/210; 503/212; 503/216; 503/217; 503/225; 427/150; 427/151

[58] Field of Search ..... 428/913, 914, 321.1, 428/321.5; 282/27.5; 427/151, 150, 145; 106/21; 346/201, 216, 217, 135.1, 210, 212, 225

[56] References Cited

U.S. PATENT DOCUMENTS

| | | | |
|---|---|---|---|
| 3,244,548 | 4/1966 | Sullivan | 427/145 X |
| 3,244,549 | 4/1966 | Farnham et al. | 427/151 X |
| 3,244,550 | 4/1966 | Farnham et al. | 427/151 X |
| 3,560,229 | 2/1971 | Farnham et al. | 106/21 |
| 4,379,721 | 4/1983 | Qualitz et al. | 282/27.5 |

FOREIGN PATENT DOCUMENTS

| | | | |
|---|---|---|---|
| 2161202 | 7/1973 | Fed. Rep. of Germany | 428/199 |
| 2102584 | 2/1983 | United Kingdom | 428/913 |

*Primary Examiner*—Thomas J. Herbert
*Attorney, Agent, or Firm*—Edward McC. Roberts; Meredith C. Findlay

[57] ABSTRACT

A pressure- or heat-sensitive recording material which, in its color reactant system, contains as a color developer for the color former, at least one substituted resorcinol compound of the formula

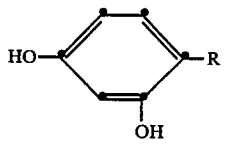

or a corresponding zinc or aluminium salt, in which R is a carboxyl- or aroyl-free substituent which has a positive Hammett para-sigma value and which is capable of forming, together with the adjacent hydroxyl group, an intramolecular hydrogen bond in the form of a six-membered ring.

12 Claims, No Drawings

PRESSURE-SENSITIVE OR HEAT-SENSITIVE RECORDING MATERIAL

The present invention relates to a pressure-sensitive or heat-sensitive recording material which, in its colour reactant system, contains as a colour developer for the colour former at least one substituted resorcinol compound of the formula

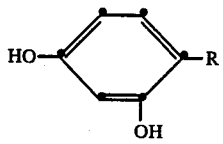

(1)

or a corresponding zinc or aluminium salt, in which R is a carboxyl- or aroyl-free substituent which has a positive Hammett para-sigma value and which is capable of forming, together with the adjacent hydroxyl group, an intramolecular hydrogen bond in the form of a six-membered ring.

Substituents having a positive (i.e. greater than zero) Hammett para-sigma value are to be understood as meaning electron-attracting substituents in the sense of the Hammett theory (L. P. Hammett, Physical Organic Chemistry, 2nd Edition, McGraw-Hill, New York, 1970, or John E. Leffler and Ernest Grunwald, Rates and Equilibria of Organic Reactions (1963), pages 172–196). The definition, however, restricts such substituents to those which are not a, or contain no, carboxyl group or aroyl group, for example benzoyl, and which form within the molecule, together with the adjacent hydroxyl group, a hydrogen bond in the form of a six-membered ring.

Examples of suitable substituents R of the type defined are: the nitro, hydroxyamide or trifluoromethyl group; aliphatic carbacyl groups having 1 to 12 carbon atoms, for example formyl, lower alkanoyl or lower alkenoyl; organosulfonyl groups, for example lower-alkylsulfonyl or arylsulfonyl, and sulfonic acid lower-alkyl or aryl ester groups, for example the sulfonic acid methyl or ethyl ester group or the sulfonic acid phenyl, lower-alkylphenyl or halogenophenyl ester group; phosphorous acid lower-alkyl or aryl ester groups, and phosphoric acid lower-alkyl or aryl ester groups; carboxylate groups, for example the carbophenoxy group, but in particular the carbobenzyloxy group or carbo(-lower)alkoxy groups, for example carbomethoxy, carbethoxy, carboisopropoxy or carbobutoxy; the sulfonamide or carboxamide group; N-monosubstituted or N,N-disubstituted carbamoyl or sulfamoyl groups having a phenyl group and/or having lower-alkyl or hydroxy(lower)alkyl groups; acyloxy groups, in particular lower alkanoyloxy, lower-alkylsulfonyloxy, benzoyloxy or phenylsulfonyloxy; and also arylazo groups or arylazomethine groups, such as the phenylazo or phenylazomethine group.

Practically important colour developers are resorcinol compounds of the formula (1) in which R is a substituent which has a positive Hammett para-sigma value and which is nitro, hydroxyamide, trifluoromethyl, formyl, lower alkanoyl, lower alkenoyl, lower alkanoyloxy, lower-alkoxycarbonyl, benzoyloxy, phenoxycarbonyl, benzyloxycarbonyl, lower-alkylsulfonyl, lower-alkylsulfonyloxy, phenylsulfonyl, phenylsulfonyloxy, lower-alkylphenoxysulfonyl, halogenophenoxysulfonyl, carbamoyl, sulfamoyl, N-(lower)alkylcarbamoyl, N-(lower)alkylsulfamoyl, N-phenylcarbamoyl, N-phenylsulfamoyl, N-hydroxy(lower)alkylcarbamoyl, N-hydroxy(lower)alkylsulfamoyl, phenylazo or phenylazomethine.

Lower alkyl and lower alkoxy are, as a rule, such groups or group components as have 1 to 5, in particular 1 to 3, carbon atoms, for example methyl, ethyl, isopropyl, sec.-butyl, tert.-butyl, methoxy, ethoxy or isopropoxy.

Lower alkanoyl and lower alkenoyl relate to a carbon chain which has at most 5 carbon atoms, for example acetyl, propionyl or butyryl or, respectively, acryloyl or crotonyl. Halogen is, for example, fluorine, bromine or preferably chlorine.

Preferred compounds of the formula (1) are those in which R is acetyl, carbomethoxy, carbethoxy, carbobenzyloxy, methylsulfonyl or phenylsulfonyl, R being in particular carbomethoxy, carbobenzyloxy or especially phenylsulfonyl.

Typical representatives of resorcinol compounds used in the invention are 2,4-dihydroxyacetophenone, methyl 2,4-dihydroxybenzoate (methyl 4-hydroxysalicylate), ethyl 2,4-dihydroxybenzoate (ethyl 4-hydroxysalicylate), phenyl 2,4-dihydroxybenzoate (phenyl 4-hydroxysalicylate), benzyl 2,4-dihydroxybenzoate (benzyl 4-hydroxysalicylate), 2,4-dihydroxydiphenyl sulfonyl (sic), 2,4-dihydroxyphenyl methyl sulfone, 4-hydroxysalicylaldehyde and 4-nitroresorcinol.

Preferred colour developers are methyl 2,4-dihydroxybenzoate, benzyl 2,4-dihydroxybenzoate and especially 2,4-dihydroxydiphenyl sulfone.

Compounds of the formula (1), which are used in the invention, are known as chemical substances, but they constitute a novel class of colour developers or electron acceptors for colour formers.

The zinc salts of resorcinol compounds of the formula (1) are preferably prepared by reacting 2 mols of a resorcinol compound of the formula (1) with 1 mol of the zinc salt of an inorganic acid or a lower aliphatic or aromatic carboxylic acid. The resulting zinc resorcinolates have the formula

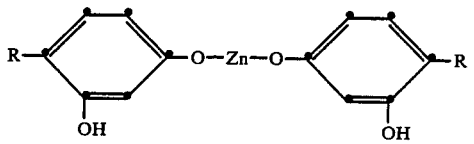

(2)

in which R is as defined above.

The reaction is advantageously carried out at a temperature of 120° to 160° C. in a melt of the resorcinol compound used which contains the zinc salt. Ammonium hydroxide, ammonium carbonate or ammonium hydrogencarbonate can be present if desired.

Specific examples of inorganic zinc salts are zinc chloride, zinc thiocyanate, zinc sulfate and zinc nitrate. If an organic zinc salt is used, it can be, for example, zinc diacetate, zinc oxalate, zinc hydrogenbenzoate or zinc dibenzoate.

It is preferred to use zinc oxide or zinc hydroxide together with zinc carbonate, zinc hydroxydicarbonate being formed.

The aluminium salts are obtained by condensing 3 mols of a resorcinol compound of the formula (1) or an alkali metal salt thereof with a water-soluble aluminium salt of an inorganic or organic acid.

The preparation preferably consists in reacting 3 mols of a resorcinol compound of the formula (1) with the aluminium salt of a lower, preferably secondary, aliphatic or cycloaliphatic alcohol, in particular with aluminium triisopropylate, aluminium sec.-butylate or aluminium cyclohexylate. The resulting aluminium resorcinolates have the formula

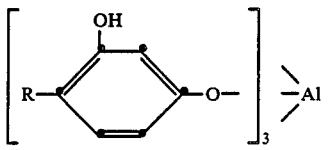

(3)

in which R is as defined above.

The reaction is advantageously carried out by heating the reactants at a temperature of 80° to 200° C. and then removing by distillation the lower aliphatic or cycloaliphatic alcohol liberated.

Compounds of the formula (1) which are used in the invention and the corresponding zinc and aluminium salts are virtually colourless and odour-free and react very readily with conventional colour formers to give instant, durable and non-fading records or copies.

The colour formers suitable for use in the novel recording material or copying material are known colourless or slightly coloured chromogenic substances which become coloured or change their colour on contact with resorcinol compounds of the formula (1) or with zinc resorcinolates of the formula (2) or with aluminium resorcinolates of the formula (3). The colour formers used alone or mixed can belong to, for example, the azomethine, fluorane, benzofluorane, phthalide, spiropyran, spirodipyran, leucoauramine, triarylmethane leuco dye, carbazolylmethane, chromenoindole, chromenopyrazole, phenoxazine, phenothiazine and the chromeno or chromano colour former class. Specific examples of suitable colour formers of these types are: crystal violet lactone, 3,3-(bisaminophenyl)phthalides, 3,3-(bis[substituted indolyl])phthalides or azaphthalides, 3-(aminophenyl)-3-indolylphthalides or -indolylazaphthalides, 6-dialkylamino-2-n-octylaminofluoranes, 6-dialkylamino-2-arylaminofluoranes, 6-dialkylamino-3-methyl-2-arylaminofluoranes, 6-dialkylamino-2- or -3-(lower)alkylfluoranes, 6-dialkylamino-2-dibenzylaminofluoranes, 6-N-cyclohexyl-N-(lower)-alkyl 3-methyl-2-arylaminofluoranes, 6-pyrrolidino-2-arylaminofluoranes, bis(aminophenyl)furylmethanes or -phenylmethanes or -carbazolylmethanes, 3'-phenyl-7-dialkylamino-2,2'-spirodibenzopyrans, bisdialkylaminobenzhydrol alkyl or aryl sulfinates, benzoyldialkylaminophenothiazines and benzoyldialkylaminophenoxazines.

Compounds of the formula (1), (2) or (3) are suitable for use as colour developers for a pressure-sensitive or, in particular, for a heat-sensitive recording material or copying material.

A pressure-sensitive material, for example, consists of at least one pair of sheets which contain at least one colour former, dissolved in an organic solvent, and a developer of the formula (1), (2) or (3).

The developers are preferably applied in the form of a layer to the front of the receiving sheet.

Developers of the formula (1), (2) or (3) can be used alone, as mixtures or in a mixture with known developers. Typical examples of known developers are active clay materials, such as attapulgus clay, acid clay, bentonite or montmorillonite; activated clay, for example acid-activated bentonite or montmorillonite; halloysite, zeolite, silicon dioxide, aluminium oxide, aluminium sulfate, aluminium phosphate, zinc chloride, zinc nitrate, kaolin or any desired clay or acidic organic compounds, for example unsubstituted or ring-substituted phenols, salicylic acid or salicylates and metal salts thereof; any acidic polymeric material, for example any phenolic polymer, any alkylphenol-acetylene resin, any maleic acid/colophony resin or any partially or fully hydrolysed polymer of maleic anhydride and styrene, ethylene or vinyl methyl ether, and carboxypolymethylene.

The developers can also be used in a mixture with essentially unreactive or barely reactive pigments or further assistants, such as silica gel. Examples of such pigments are talc, titania, zinc oxide, chalk, clays, such as kaolin, and organic pigments, for example urea-formaldehyde or melamine-formaldehyde condensation products.

The colour former produces a coloured marking at points where it comes into contact with the developer. Premature activation of the colour formers present in the pressure-sensitive recording material is prevented by generally keeping the colour formers separate from the developer. This can be advantageously accomplished by incorporating the colour formers into foam-, sponge- or honeycomb-like structures. The colour formers are preferably enclosed in microcapsules which, as a rule, can be broken by applying pressure.

On fracture of the capsules by pressure, for example by means of a pencil, the colour former solution transfers to an adjacent sheet coated with the developer of the formula (1), (2) or (3), and thereby produces a coloured spot. The colour of this spot is due to the dye which is formed in the course of crushing the microcapsules and which absorbs in the visible region of the electromagnetic spectrum.

The colour formers are preferably encapsulated in the form of solutions in organic solvents. Examples of suitable solvents are, preferably, non-volatile solvents, for example polyhalogenated paraffin or diphenyl, such as chloroparaffin, monochlorodiphenyl or trichlorodiphenyl, tricresyl phosphate, di-n-butyl phthalate, or dioctyl phthalate; aromatic ethers, such as benzyl phenyl ether; hydrocarbon oils, for example paraffin or kerosine, alkylated derivatives (for example with isopropyl, isobutyl, sec.-butyl or tert.-butyl) of diphenyl, diphenylalkanes, naphthalene or triphenyl, dibenzyltoluene, terphenyl, partially hydrogenated terphenyl, benzylated xylenes, mono- or tetramethylated diphenylalkanes or other chlorinated or hydrogenated condensed aromatic hydrocarbons. Many cases employ mixtures of various solvents to obtain maximum colour-formation solubility, rapid and intense colouring and a favourable microencapsulation viscosity.

The capsule walls can be evenly shaped about the droplets of colour former solution by coacervation forces out of such an encapsulating material as, for example, gelatin and gum arabic, as described, for example, in U.S. Pat. No. 2,800,457. The capsules can preferably also be formed by polycondensation from an aminoplast or modified aminoplasts, as described in British Pat. Nos. 989,264, 1,156,725, 1,301,052 and 1,355,127. Interfacial polymerisation also gives suitable microcapsules, for example capsules made of polyester, polycarbonate, polysulfonamide, polysulfonate or, especially polyamide or polyurethane.

Microcapsules containing colour former can be combined with colour developers to give pressure-sensitive copying materials of various known types. The various systems essentially differ from one another by the arrangement of the capsules, of the colour reactants, i.e. of the developers, and by the support material. In the preferred arrangement, the encapsulated colour former is present in the form of a layer on the back of a transfer sheet and the developer to be used in the invention is present in the form of a layer on the front of a receiving sheet.

In another arrangement of the components, the microcapsules containing colour former, and the developer are present in or on the same sheet in the form of one or more individual layers or in the paper pulp.

The capsules are preferably fixed on the support by means of a suitable binder. Since paper is the preferred support material, this binder will in the main be a paper-coating agent, such as gum arabic, polyvinyl alcohol, hydroxymethylcellulose, casein, methylcellulose, dextrin, starch, starch derivatives or polymer latexes. Examples of the latter are butadiene-styrene copolymers and acrylic monopolymers or copolymers.

The paper used is not only normal papers made of cellulosic fibres, but also papers in which the cellulosic fibres have been replaced (partially or completely) by fibres made of synthetic polymers.

Compounds of the formula (1), (2) or (3) are preferably used as developers in a thermo-reactive recording material. The latter, as a rule, contains at least a support, a colour former and a developer and can, if desired, also contain a binder.

Thermo-reactive recording systems include, for example, heat-sensitive recording and copying materials and papers. These systems are used, for example, for recording information, for example in computers, telecopiers, teleprinters or recorders and measuring instruments, for example electrocardiographs. Imaging (marking) can also be effected by hand with a hot pen. Another way of producing markings by means of heat is laser beams.

A possible structure for the thermo-reactive recording material is for the colour former to be dissolved or dispersed in a layer of binder and for the developer to be dissolved or dispersed in the binder in a second layer. In another possible structure, both colour former and developer are dispersed within one layer. The binder is softened by means of heat in specific areas, and it is at these points, where the heat is applied, that the colour former comes into contact with the developer to develop at once the desired colour.

Developers of the formula (1), (2) or (3) can also be used in heat-sensitive recording materials alone, as mixtures or in a mixture with known developers.

These known developers can be the same developers as used in pressure-sensitive papers, as well as phenolic compounds, for example 4-tert.-butylphenol, 4-phenylphenol, methylene-bis(p-phenylphenol), 4-hydroxydiphenyl ether, α-naphthol, α-naphthol, methyl 4-hydroxybenzoate, 4-hydroxyacetophenone, 2,2'-dihydroxydiphenyl, 4,4'-isopropylidenediphenol, 4,4'-isopropylidenebis(2-methylphenol), 4,4'-bis-(hydroxyphenyl)-valeric acid, hydroquinone, pyrogallol, phloroglucine, p-, m- or o-hydroxybenzoic acid, gallic acid or 1-hydroxy-2-naphthoic acid, boric acid or organic, preferably aliphatic, dicarboxylic acids, for example tartaric acid, oxalic acid, maleic acid, citric acid, citraconic acid or succinic acid.

A thermoreactive recording material is preferably prepared with fusible film-forming binders. These binders are normally water-soluble, while the colour formers and the developer are insoluble in water. The binder should be capable at room temperature of dispersing and fixing the colour former and the developer.

Under heat the binder softens or melts, so that the colour former comes into contact with the developer and a colour can form. Examples of water-soluble or at least water-swellable binders are hydrophilic polymers, such as polyvinyl alcohol, polyacrylic acid, hydroxyethylcellulose, methylcellulose, carboxymethylcellulose, polyacrylamide, polyvinylpyrrolidone, gelatin, starch and etherified corn starch.

If the colour former and the developer are present in two separate layers, it is possible to use water-insoluble binders, i.e. binders which are soluble in non-polar or only weakly polar solvents, for example natural rubber, synthetic rubber, chlorinated rubber, alkyd resins, polystyrene, styrene/butadiene copolymers, polymethacrylates, ethylcellulose, nitrocellulose or polyvinylcarbazole. In the preferred arrangement, however, the colour former and the developer are present in one layer in a water-soluble binder.

The thermoreactive layers can contain further additives. To improve whiteness, to facilitate printing on paper and to prevent adhesion of the hot pen, these layers can contain, for example, talc, titania, zinc oxide, aluminium hydroxide, calcium carbonate (for example chalk), clays such as kaolin, and organic pigments, for example urea-formaldehyde or melamine-formaldehyde polymers. So that the colour develops only within a limited temperature range, it is possible to add substances such as urea, thiourea, diphenylthiourea, acetamide, acetanilide, stearamide, phthalic anhydride, metal chlorides, metal stearates, for example zinc stearate, phthalonitrile or other such fusible products as will induce the colour former and the developer to melt simultaneously. Thermographic recording materials preferably contain waxes, for example carnauba wax, montana wax, paraffin wax, polyethylene wax or condensates of higher fatty acid amines and formaldehyde or condensates of higher fatty acids and ethylenediamine.

In the examples which follow, percentages and parts are by weight, unless otherwise stated.

EXAMPLE 1

First, two dispersions (A and B) are prepared. Dispersion A is prepared by grinding 1 g of crystal violet lactone and 10 g of a 5% aqueous solution of polyvinyl alcohol 25/140 to a particle size of 2 to 4μ.

Dispersion B is prepared by bead-milling to a particle size of 2 to 4μ.

6 g of methyl 2,4-dihydroxybenzoate (melting point 116°–118° C.)

1.5 g of zinc stearate 2.5 g of coating kaolin 0.6 g of stearamide and 30 g of a 5% aqueous solution of polyvinyl alcohol 25/140.

The two dispersions are then mixed. The mixture is then applied to paper in such a way that the dry coating weight is 4 g/m$^2$.

The heat sensitive recording paper thus prepared has a colourless surface and is stable at room temperature.

EXAMPLE 2

Preparation of a heat-sensitive recording paper by the method described in Example 1 using the following dispersions C and D:

Dispersion C 1 g of crystal violet lactone and 6 g of a 10% aqueous polyvinyl alcohol solution Dispersion D 4 g of 2,4-dihydroxyacetophenone (melting point 143°–146° C.)

0.8 g of zinc stearate 2.4 g of urea-formaldehyde condensate (B.E.T. surface area 20 $m^2/g$)

0.5 g of coating kaolin 0.3 g of paraffin wax and 24 g of a 10% aqueous solution of polyvinyl alcohol.

Application level: 4 $g/m^2$ (dry weight).

In Examples 1 and 2, crystal violet lactone can be successfully replaced by the colour formers 2-phenylamino-3-methyl-6-diethylaminofluorane, 2-(2'-chlorophenylamino)-6-diethylaminofluorane or 2-phenylamino-3-methyl-6-(N-cyclohexyl-N-methylamino)fluorane and the specified resorcinol compounds by the colour developers 2,4-dihydroxydiphenyl sulfone (melting point 120°–123° C.), 4-hydroxysalicylaldehyde (melting point 135°–137° C.) or benzyl 2,4-dihydroxybenzoate (melting point 89°–91° C.).

EXAMPLE 3

A solution of 3 g of crystal violet lactone in 97 g of partially hydrogenated terphenyl is emulsified in a solution of 12 g of pigskin gelatin in 88 g of water at 50° C. A solution of 12 g of gum arabic in 88 g of water at 50° C. is added, followed by 200 ml of water at 50° C. The resulting emulsion is poured into 600 g of ice-water, and cooled to effect coacervation. A sheet of paper is coated with the resulting suspension of microcapsules, and dried.

A second sheet of paper is coated with an aqueous dispersion E which has a 35% solids content comprising 12 g of 2,4-dihydroxydiphenyl sulfone (melting point 120°–123° C.), 70 g of kaolin, 23 g of silica gel, 9 g of chalk, 6 g of a styrene/butadiene copolymer and 10 g of starch.

Application level: 6 $g/m^2$ base paper.

The first sheet and the paper coated with 2,4-dihydroxydiphenyl sulfone are placed on top of each other in such a way that the coatings are adjacent to each other. Pressure is exerted on the first sheet through writing by hand or with a typewriter, and at once an intensive blue copy develops on the developer-coated sheet.

EXAMPLE 4

A heat-sensitive recording paper involving the use of the following two dispersions F and G as in the method described in Example 1.

Dispersion F 8 g of 2,4-dihydroxydiphenyl sulfone (melting point 120°–123° C.)

32 g of a 10% aqueous polyvinyl alcohol solution 20 g of water

Dispersion G 1 g of 2-phenylamino-3-methyl-6-diethylaminofluorane 4 g of a 10% aqueous polyvinyl alcohol solution 2.5 g of water Application level: about 2.7 $g/m^2$ (dry weight).

The ground colour of the recording paper obtained in this way is white; at 80° C. a black colour develops and reaches its full depth of shade of 150° C.

EXAMPLE 5

Example 4 is repeated, except that 8 g of benzyl 2,4-dihydroxybenzoate are used in place of 2,4-dihydroxydiphenyl sulfone in dispersion F. Application weight: about 3 $g/m^2$ (dry weight).

The paper thus prepared develops a black colour at 80° C., the full depth of shade of which is reached at as low a temperature as 100° C.

EXAMPLE 6

A finely ground dispersion of the composition 1 g of the zinc salt of methyl 2,4-dihydroxybenzoate of the formula

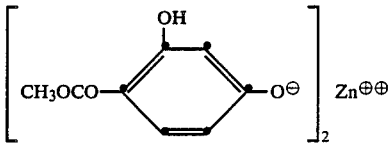

5 g of coating kaolin, 0.1 g of silica gel, 1.5 g of a styrene/butadiene copolymer (50%) and 9 g of water is doctor-coated onto a raw paper which has a weight per unit area of 48 $g/m^2$. Application weight: 6 $g/m^2$. The receiver layer thus prepared is placed adjacent to the donor layer of a commercially available copy paper. The donor layer contains the colour former encapsulated in microcapsules. Pressure applied through writing by hand or with a typewriter produces an intensely coloured copy.

The zinc salt used in this example as a colour developer is prepared as follows:

34.7 g of methyl 2,4-dihydroxybenzoate and 11.12 g of zinc hydroxydicarbonate (58.8% by weight Zn content) are stirred for 30 minutes at 130° C. and are then treated without stirring for 4 hours at 145°–150° C. After cooling down to room temperature, the hard mass is pulverised and suspended in 250 ml of acetone. The zinc salt obtained is then filtered off, washed with acetone and dried at 40° C. in vacuo. This gives 26.65 g of the zinc salt of methyl 2,4-dihydroxybenzoate in the form of a pale beige powder which melts at >250 C.

What is claimed is:

1. A pressure- or heat-sensitive recording material, which, in its color reactant system, contains as a color developer for the color former, a substituted resorcinol compound of the formula

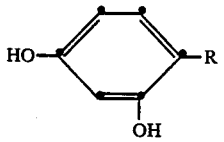

(1)

or its corresponding zinc or aluminium salt, in which R is selected from the group consisting of nitro, hydroxyamide, trifluoromethyl, formyl, lower alkanoyl, lower alkenoyl, lower alkanoyloxy, lower-alkoxycarbonyl, benzoyloxy, phenoxycarbonyl, benzyloxycarbonyl, lower-alkylsulfonyl, lower-alkylsulfonyloxy, phenylsulfonyl, phenylsulfonyloxy, lower-alkylphenoxysulfonyl, halogenophenoxysulfonyl, carbamoyl, sulfamoyl, N-(lower)alkylcarbamoyl, N-(lower)alkylsulfamoyl, N-phenylcarbamoyl, N-phenylsulfamoyl, N-hydroxy(-lower)alkylcarbamoyl, N-hydroxy(lower)alkylsulfamoyl, phenylazo and phenylazomethine.

2. The recording material of claim 1, which contains as a color developer a metal-free resorcinol compound of the formula (1).

3. The pressure-sensitive or heat-sensitive recording material of claim 1, in which the compound of the formula (1) or the corresponding zinc or aluminium salt is present together with one or more other color developers.

4. The recording material of claim 1, in which the color developer has the formula (1) in which R is acetyl, carbomethoxy, carbethoxy, carbobenzyloxy, methylsulfonyl or phenylsulfonyl.

5. The recording material of claim 1, in which the color developer has the formula (1) in which R is carbomethoxy, carbobenzyloxy or phenylsulfonyl.

6. The recording material of claim 1, which is heat-sensitive.

7. The heat-sensitive recording material of to claim 6, which contains in at least one layer at least one color former, at least one color developer and, if desired, at least one binder.

8. The recording material of claim 1, which is pressure-sensitive.

9. The pressure-sensitive recording material of claim 8, which contains the color former dissolved in an organic solvent.

10. The pressure-sensitive recording material of claim 9, in which the color former is encapsulated in microcapsules.

11. The pressure-sensitive recording material of claim 8 in which the color former is encapsulated in microcapsules.

12. The pressure-sensitive recording material of claim 11, in which the encapsulated color former is present in the form of a layer on the back of a transfer sheet and the color developer of the formula (1) or the corresponding zinc or aluminium salt is present in the form of a layer on the front of a receiving sheet.

* * * * *